US005464303A

United States Patent [19]

Wells

[11] Patent Number: 5,464,303

[45] Date of Patent: Nov. 7, 1995

[54] METHOD FOR REPAIRING PAVEMENT

[75] Inventor: Raymond Wells, Clearwater, Fla.

[73] Assignee: D.W.T. Innovative Recycling Corp., Tarpon Springs, Fla.

[21] Appl. No.: 175,933

[22] Filed: Dec. 30, 1993

[51] Int. Cl.[6] ..... E01C 7/32

[52] U.S. Cl. ..... 404/75; 404/82

[58] Field of Search ..... 404/75, 78, 82

[56] References Cited

U.S. PATENT DOCUMENTS

| | | | |
|---|---|---|---|
| 1,581,507 | 4/1926 | Benedict et al. . | |
| 1,610,756 | 12/1926 | De La Mare . | |
| 1,707,391 | 4/1929 | Fox . | |
| 2,128,480 | 8/1938 | Wertz . | |
| 3,344,608 | 10/1967 | McEachran . | |
| 3,581,631 | 6/1971 | Rozendaal et al. . | |
| 3,601,016 | 8/1971 | van der Ploeg Velp et al. . | |
| 3,608,443 | 9/1971 | Gagle et al. . | |
| 3,608,444 | 9/1971 | Levy et al. . | |
| 3,761,190 | 9/1973 | Thaning | 404/82 |
| 3,915,582 | 10/1975 | Clarke . | |
| 4,168,924 | 9/1979 | Draper et al. | 404/82 |
| 4,265,563 | 5/1981 | Marzocchi et al. . | |
| 4,309,124 | 1/1982 | Bertels . | |
| 4,428,698 | 1/1984 | Murphy et al. . | |
| 4,507,013 | 3/1985 | Martinak . | |
| 4,668,548 | 5/1987 | Lankard . | |
| 4,801,217 | 1/1989 | Goldberg . | |
| 4,948,431 | 8/1990 | Strickland et al. . | |
| 5,009,543 | 4/1991 | Ahmad et al. . | |
| 5,185,013 | 2/1993 | Martin | 404/75 X |
| 5,257,880 | 11/1993 | Janopaul, Jr. | 405/284 |

*Primary Examiner*—William P. Neuder
*Attorney, Agent, or Firm*—Fish & Neave

[57] ABSTRACT

There is provided a method and apparatus for repairing pavement quickly, durably, and at low cost which may employ the use of recycled plastic material. The method includes the steps of: lining the hole to be repaired with a cross-laminated plastic vapor barrier, placing a plastic mesh and one or more plastic pencil rods in the hole, optionally supporting the pencil rods with plastic pencil rod supports, and filling the hole with patch material such as asphalt or concrete. The method is useful in the repair or repaving of pot holes, utility crossings and channels, sink holes, wash out damage, edge collapse, intersection grid repair, and similar conditions.

42 Claims, 4 Drawing Sheets

METHOD FOR REPAIRING PAVEMENT

BACKGROUND OF THE INVENTION

This invention relates to the repair or repaving of pot holes, utility crossings and channels, sink holes, wash out damage, edge collapse, intersection grid repair, and other conditions which require repair to pavement. More particularly, this invention relates to the repair of pavement with asphalt or concrete by a method which may be performed quickly and inexpensively and which results in a more durable and permanent repair. This invention may also be applied to new construction or the repair of large sections of pavement. This invention also provides a quick and convenient means of placing sensors within a paved surface for purposes such as monitoring traffic density, monitoring road deterioration, or traffic signal control. Additionally, the preferred embodiment of this method makes use of recycled plastic products and thus contributes to the quality of the environment and to the conservation of energy resources.

Typically, pavement is repaired by filling holes with asphalt or concrete alone. While this method is relatively quick to perform, the resulting patches wear out easily, often within one or two years. The causes of this failure include undermining, which occurs when water seeps in between the patch and the road surface. Impacts and vibrations caused by traffic contribute to loosening and disintegration of the patch. In addition, heaving may occur when water seeps into or under the patch and subsequently freezes. As a result of these forces, the typical patch must be reapplied frequently.

Various attempts to improve pavement repair have been made. Martinak, U.S. Pat. No. 4,507,013, discloses a method of making more permanent patches by the use of "randomly oriented flexible filamentary material" anchored to the preexisting pavement by "nails, spikes, staples, or the like" before the patch material is applied. The method of Martinak precludes the use of an effective vapor barrier to line the hole, because it requires anchoring nails or spikes, which would puncture a vapor barrier. The "filamentary material" of this method does not have structural rigidity and cannot effectively absorb or distribute impacts and vibrations caused by traffic.

Levy et al., U.S. Pat. No. 3,608,444, discloses the use of a polypropylene fabric sprayed with an adhesive. The fabric is laid down on the surface of the existing pavement before the patch is applied. Levy requires that the surface of the underlying pavement is rough; if necessary, the surface is made rough by spreading aggregate on the surface before applying the fabric. The points and ridges of the rough surface must stretch the fabric when the patch is applied. Levy requires the use of an adhesive. Levy does not disclose the use of structural members.

Strickland et al., U.S. Pat. No. 4,948,431, discloses a liquid "patch binder" to improve binding of the patch to the existing pavement. The "patch binder," which is composed of toluene, cyclohexanone, N-methylpyrrolidone, a surfactant, and a dye, is sprayed on the exposed road surface before the hole is filled with patch material. Strickland does not disclose the use of a vapor barrier or structural members.

It would be desirable to be able to repair holes quickly and at low cost while providing a durable repair.

SUMMARY OF THE INVENTION

It is an object of this invention to provide a method of repairing pavement quickly and at low cost which results in a durable repair. It is a further object of this invention to make use of recycled plastics. It is a further object of this invention to provide a means to place sensors within a paved surface.

In accordance with the present invention, there is provided a method and apparatus for repairing holes in pavement. The method includes the steps of: lining the hole with a vapor barrier, placing a mesh and one or more pencil rods in the hole, optionally tying the pencil rods to pencil rod supports, and filling the hole with patch material such as asphalt or concrete. The apparatus includes a vapor barrier, mesh, pencil rods, pencil rod supports, and ties, which may all be made of recycled plastic. The mesh can be adapted to contain sensors, including microchip sensors, at the intersections of the crosspieces which make up the mesh. Such sensors are useful in counting traffic, controlling traffic lights, and monitoring road deterioration.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

The method according to the present invention provides a quick and durable repair by the use of structural elements which block the infiltration of water and distribute and dampen vibrations and impacts.

In one embodiment, pot holes, wash out damage, edge collapse, and the like are repaired with asphalt. The hole in the pavement 10 is first prepared by removing loose material such as soil or pieces of roadbed material. The hole is then lined with a piece of vapor barrier material 20. The vapor barrier prevents undermining of the repair by preventing water from infiltrating between the repair and the underlying roadbed. In one embodiment the vapor barrier is a cross-laminated plastic sheet approximately 3–7 mil thick. The vapor barrier may be made of recycled plastic. Any uniform and mixable plastic which can be formed into uniform sheets of the appropriate thickness and which will form a barrier to water may be used. Plastic sheeting cast from a regrind composed of recycled garbage bags is preferred as a vapor barrier. In a preferred embodiment using hot asphalt patch material, the vapor barrier is composed of material that softens at the temperature of the hot asphalt as it is applied. This temperature is typically in the range of 275°–325° F.

Figure 1:
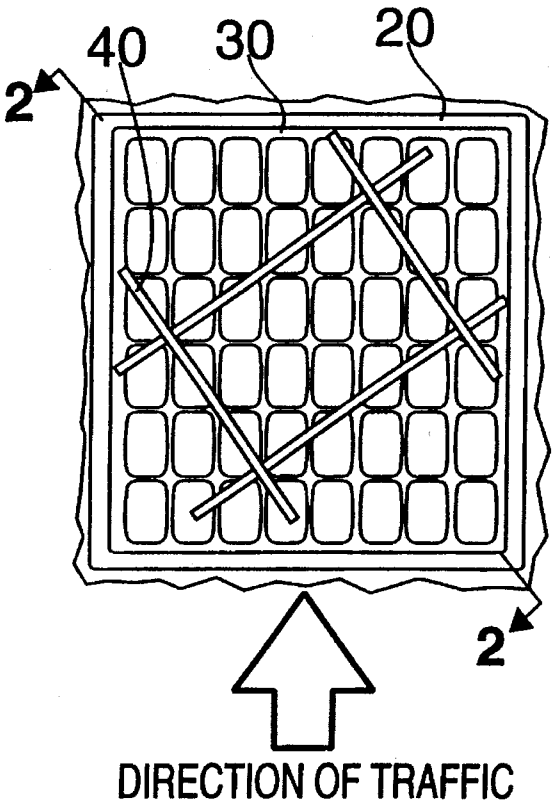
FIG. 1 is a top view of a pot hole repair before the addition of asphalt patch material.
Figure 3:
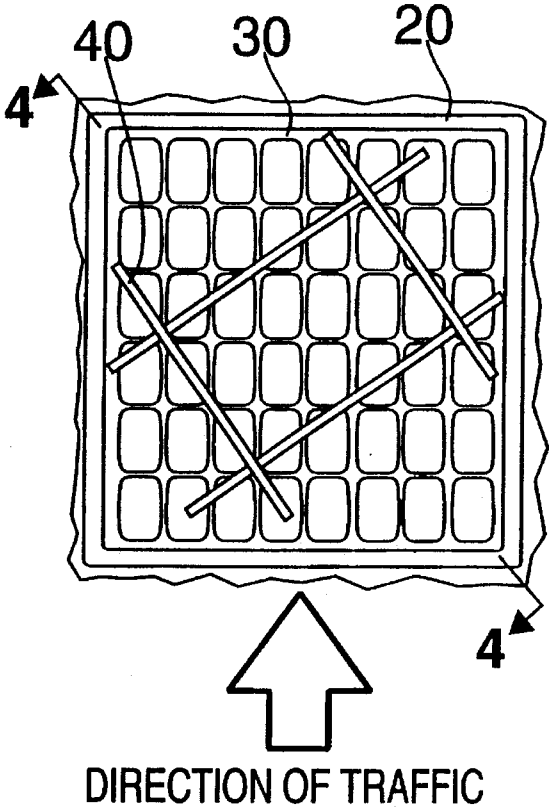
FIG. 3 is a top view of a wash out damage repair before thee addition of asphalt patch material.
Figure 5:
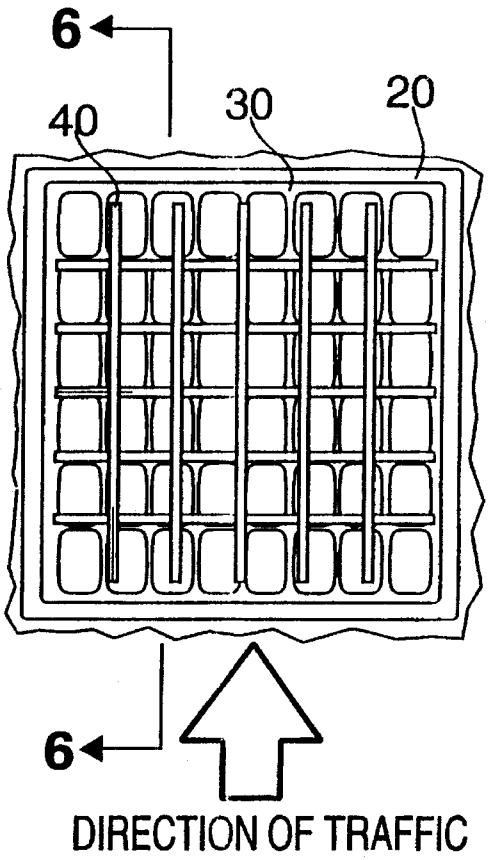
FIG. 5 is a top view of a pot hole repair before the addition of concrete patch material.
Figure 2:
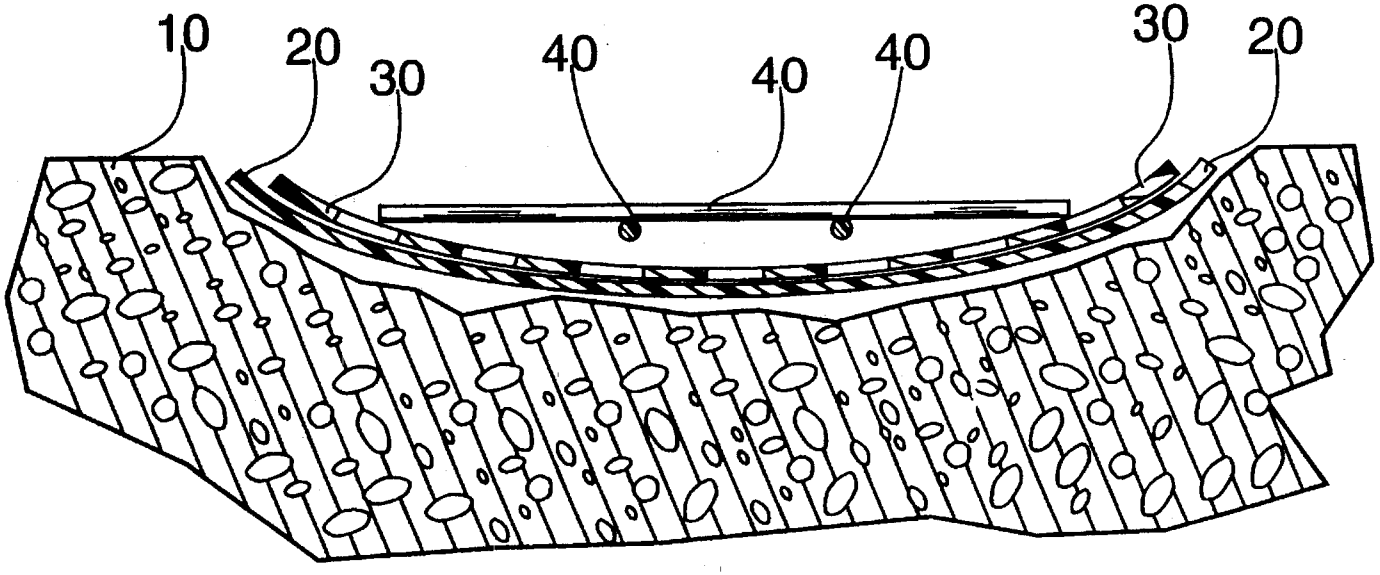
FIG. 2 is a sectional view of a pot hole repair with asphalt.
Figure 4:
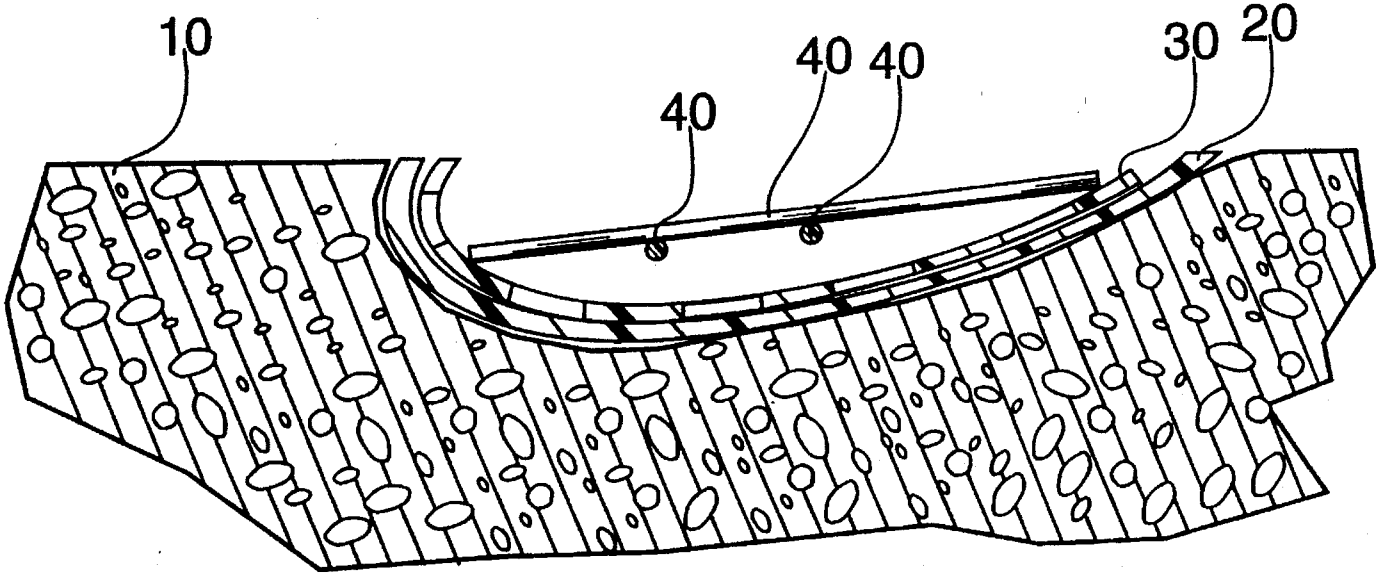
FIG. 4 is a sectional view of a wash out damage repair with asphalt.
Figure 6:
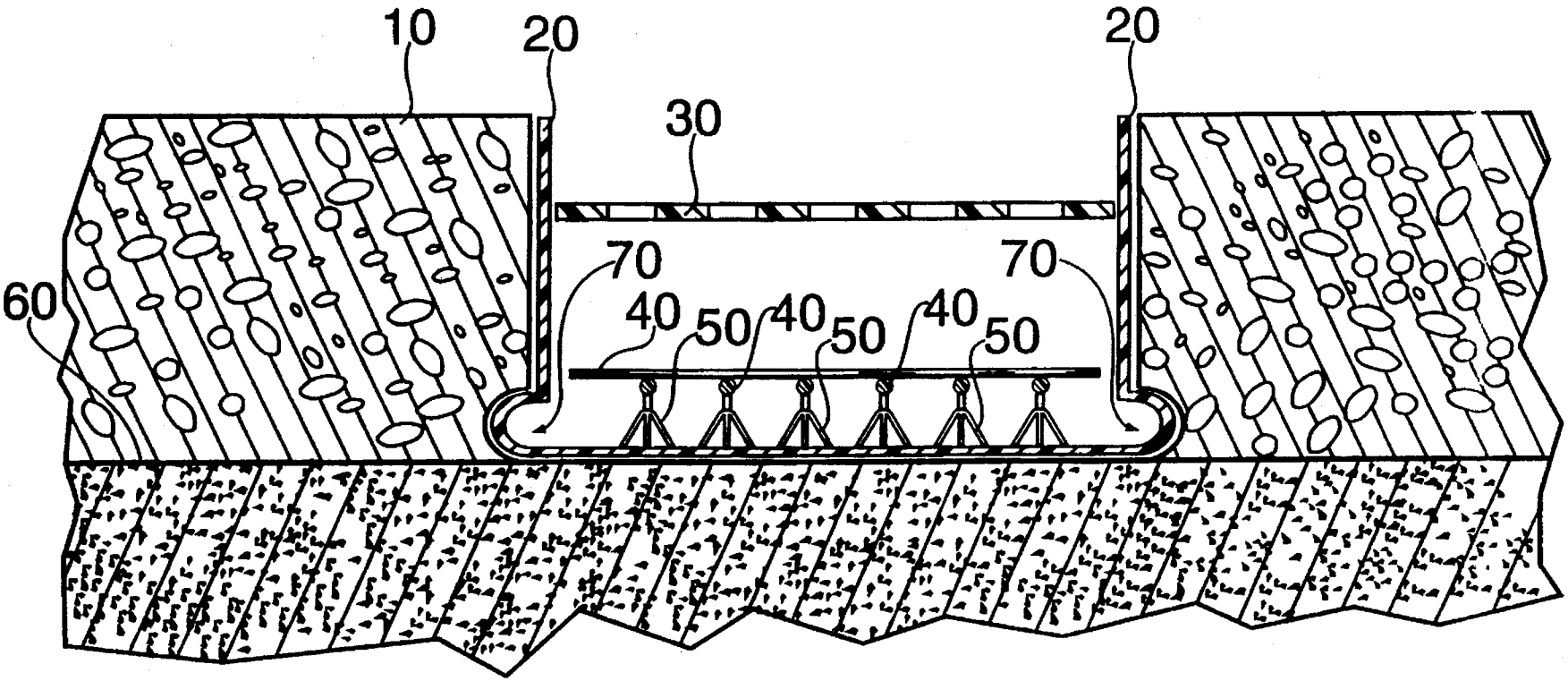
FIG. 6 is a sectional view of a pot hole repair with concrete.
Figure 7:
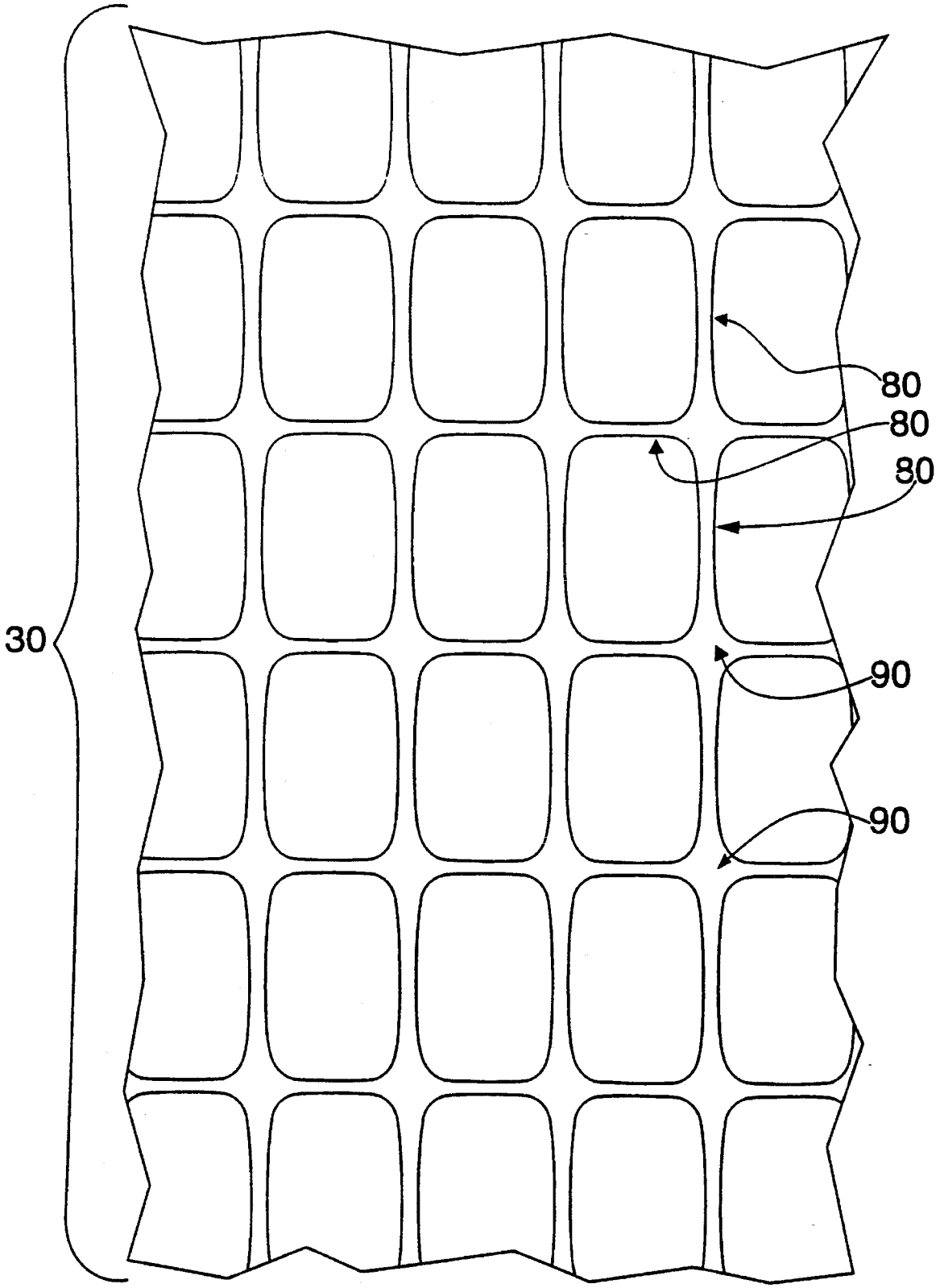
FIG. 7 is a view of a grid-type mesh suitable for use in the present invention.

In this embodiment, a piece of mesh 30 [FIG. 7] is then placed over the vapor barrier 20. The mesh is cut smaller than the vapor barrier so as to leave about a two inch margin around each edge. In a preferred embodiment, the mesh is in the shape of a grid having roughly rectangular openings measuring approximately 2" by 3" and varying in thickness from about 1/15", at the crosspieces 80, to 1/6", at the intersections 90. The mesh acts to distribute and dampen vibrations and to distribute weight placed directly on the repair. The mesh may be made of recycled plastic. Any uniform and mixable plastic which can be formed into the appropriate shape may be used. In a preferred embodiment using hot asphalt patch material, the mesh is composed of material that softens at a temperature higher than the temperature of the hot asphalt as it is applied. Thus the mesh preferably does not soften substantially below about 325° F.

In this embodiment, pencil rods 40 are placed on top of the mesh 30. The pencil rods are preferably placed orthogonal to each other and at an angle of 45° to the direction of traffic. In one embodiment the pencil rods are cylindrical and between about 3/8 and 1/2 in diameter. They can be any length, but are preferably cut to fit across the area to be repaired. The pencil rods act to absorb impacts and stabilize the repair. Like the mesh, the pencil rods may be made of recycled plastic. The description of materials useful for making the mesh applies to the pencil rods as well.

In this embodiment, the hole is then filled with asphalt and compacted in the usual manner.

Another embodiment relates to repairs made with concrete to holes of more than 3" depth. The hole in the pavement 10 is first prepared by removing loose material such as soil or pieces of roadbed material. If the hole extends down to exposed soil 60, a lip 70 is dug into the lower perimeter of the hole to create a bell-shaped hole. The hole is then lined with a piece of vapor barrier material 20.

In this embodiment, pencil rod supports 50 are then placed in the hole at six inch centers over the entire base of the hole. The pencil rod supports hold the pencil rods 40 above the base of the hole. In one embodiment, the pencil rod supports are pyramidal in shape, having a base roughly 3" on a side, with a clip at the top for receiving the pencil rods and supporting them at a height of about 2½". Like the mesh and the pencil rods, the pencil rod supports may be made of recycled plastic. The description of materials useful for making the mesh applies to the pencil rod supports as well.

In this embodiment, pencil rods 40 are then placed on the pencil rod supports 50. The pencil rods are preferably placed orthogonal to each other and to the direction of traffic. The pencil rods are then tied to the pencil rod supports with plastic ties. Like the mesh, the pencil rods, and the pencil rod supports, the ties may be made of recycled plastic. The description of materials useful for making the mesh applies to the ties as well.

In this embodiment, concrete is then poured to a depth of about one inch above the pencil rods. The mesh 30 is then placed on top of the concrete. The hole is then filled to the desired depth with more concrete.

Yet another embodiment relates to repairs made with concrete to holes of less than 3" depth. The preceding method is followed, except that the pencil rod supports are eliminated and the pencil rods are placed directly on the vapor barrier.

Any of the previous embodiments may be applied to areas of potentially unlimited extent, including new construction, by the following adaptations. Shorter lengths of pencil rod may be used in place of a longer pencil rod by overlapping the rods and tying them together. While pencil rods may be extruded in potentially unlimited lengths, lengths of more than ten feet are difficult to transport. Large sections of mesh may be joined at the edges by weaving lengths of pencil rod between the crosspieces to sew the edges together. Large sections of vapor barrier may be joined at the edges with tape, preferably about 6" in width.

Any of the previous embodiments may be used with one or more element omitted. For example, the mesh of the present invention may be used without the vapor barrier or pencil rods to add strength and durability to newly constructed road surfaces.

This invention also provides a quick and convenient means of placing sensors within a paved surface for purposes such as monitoring traffic density, monitoring road deterioration, or traffic signal control. The mesh of the present invention may be adapted to contain sensors, including microchip sensors, at the intersections 90 of the crosspieces 80 which make up the mesh. Wires to carry power to the sensors and data from the sensors may be embedded in the crosspieces 80 or may be embedded in the patch material. For remote applications, power may be supplied by solar panels.

EXAMPLE 1

Repairs were made using both asphalt and concrete in the town of Belleair, Fla. The roads of Belleair are subject to strong marine corrosion conditions, due to its location on the Gulf of Mexico.

The repairs using concrete were performed according to the preferred embodiment for repairs with concrete for holes of more than 3" depth, described above. The holes were square cut, measuring approximately 2½' on a side and approximately 6"–7" deep. Four of the areas repaired with concrete were in high impact areas.

The repairs using asphalt were performed according to the preferred embodiment for repairs with asphalt described above. One repair was for a hole cut for utility service. The hole was square cut, measuring approximately 3' on a side and approximately 3" deep. Two repairs were for utility channels. The first measured approximately 1½' wide, 30' long, and 2½ deep, and the second measured approximately 6" wide, 10' long, and 2" deep. Other asphalt repairs varied in area from ½ square foot to 12 square feet. Four of the asphalt repairs were in high impact areas.

The concrete and asphalt repairs have shown no signs of failure after two years and four months in place.

EXAMPLE 2

Repairs were made using asphalt in a cold weather climate in the city of New York, N.Y.

The repairs were performed according to the preferred embodiment for repairs with asphalt described above. Two of these repairs have been monitored on a bi-weekly basis. The first is in a high traffic area and measures approximately 2' by 2'. The second is in a low traffic area but has required very frequent repair because the hole is bordered on three sides by cobblestones. The second area measures roughly 3' by 5' by 6–7" deep.

These two asphalt repairs have been monitored on a bi-weekly basis. They have shown no signs of failure after four months of Autumn and Winter exposure.

EXAMPLE 3

A test block was made according to the preferred embodiment for repairs with concrete for holes of less than 3" depth, described above. The block measures roughly 6" by 8" by 5". The vapor barrier lies parallel to the largest face of the block, between a base layer of concrete which represents the underlying pavement and an upper layer of concrete which represents a repair. The mesh and pencil rods are embedded in the upper layer in accordance with the present invention.

The block was immersed in a saturated solution of Sodium Sulfite. The concentration of the saturated solution is roughly 10%. The bath was kept at room temperature and stirred periodically.

The test is an accelerated demonstration of the effects of exposure to a corrosive environment. It is estimated that one year of immersion is equivalent to 7 to 10 years of exposure to seaside corrosion conditions. The test block has shown no signs of deterioration after more than two years of immersion.

Thus it is seen that a method is provided to repair pavement quickly and at low cost which results in a durable repair. One skilled in the art will appreciate that the present invention can be practiced by other than the described embodiments, which are presented for purposes of illustration and not of limitation, and the present invention can be practiced only by the claims which follow.

What is claimed is:

1. A method for repairing pavement, comprising the steps of:

lining an area to be repaired with a vapor barrier;

placing a combination of a mesh and at least one pencil rod on the vapor barrier; and filling the area to be repaired with a patch material.

2. The method of claim 1, wherein the vapor barrier, mesh, and pencil rod are made of plastic.

3. The method of claim 2, wherein the vapor barrier is a cross-laminated plastic sheet which measures approximately 3–7 mil in thickness.

4. The method of claim 3, wherein the mesh comprises a plurality of crosspieces which form generally rectangular openings measuring approximately 2" by 3" and measures between approximately 1/15" and 1/6" in thickness.

5. The method of claim 4, wherein the pencil rod is a plastic cylinder approximately 3/8" to 1/2" in diameter.

6. The method of claim 5, wherein the vapor barrier is made of a plastic material which softens at 275°–325° F.

7. The method of claim 6, wherein the mesh and pencil rod are made of a second plastic material which does not soften substantially below 325° F.

8. The method of claim 7, wherein the vapor barrier, mesh, and pencil rod are made of recycled plastic.

9. The method of claim 1, wherein the step of:

placing a combination of a mesh and at least one pencil rod on the vapor barrier; is accomplished by:

placing a mesh on the vapor barrier; and placing at least one pencil rod on the mesh.

10. The method of claim 9, wherein the patch material is asphalt.

11. The method of claim 10, wherein the vapor barrier, mesh, and pencil rod are made of plastic.

12. The method of claim 11, wherein the vapor barrier is a cross-laminated plastic sheet which measures approximately 3–7 mil in thickness.

13. The method of claim 12, wherein the mesh comprises a plurality of crosspieces which form generally rectangular openings measuring approximately 2" by 3" and measures between approximately 1/15" and 1/6" in thickness.

14. The method of claim 13, wherein the pencil rod is a plastic cylinder approximately 3/8" to 1/2" in diameter.

15. The method of claim 14, wherein the vapor barrier is made of a plastic material which softens at 275°–325° F.

16. The method of claim 15, wherein the mesh and the pencil rod are made of a second plastic material which does not soften substantially below 325° F.

17. The method of claim 16, wherein the vapor barrier, mesh, and pencil rod are made of recycled plastic.

18. A method for repairing pavement, comprising the steps of:

lining an area to be repaired with a vapor barrier;

placing at least one pencil rod support on the vapor barrier;

placing at least one pencil rod on the pencil rod supports;

partially filling the area to be repaired with a patch material;

placing a mesh on the patch material; and filling the area to be repaired with the patch material.

19. The method of claim 18, wherein the patch material is concrete.

20. The method of claim 19, wherein the vapor barrier, mesh, pencil rod, and pencil rod support are made of plastic.

21. The method of claim 20, wherein the vapor barrier is a cross-laminated plastic sheet which measures approximately 3–7 mil in thickness.

22. The method of claim 21, wherein the mesh comprises a plurality of crosspieces which form generally rectangular openings measuring approximately 2" by 3" and measures between approximately 1/15" and 1/6" in thickness.

23. The method of claim 22, wherein the pencil rod is a plastic cylinder approximately 3/8" to 1/2" in diameter.

24. The method of claim 23, wherein the vapor barrier, mesh, pencil rod, and pencil rod support are made of recycled plastic.

25. A method for repairing pavement, comprising the steps of:

lining an area to be repaired with a vapor barrier;

placing at least one pencil rod on the vapor barrier;

partially filling the area to be repaired with a patch material;

placing a mesh on the patch material; and filling the area to be repaired with the patch material.

26. The method of claim 25, wherein the patch material is concrete.

27. The method of claim 26, wherein the vapor barrier, mesh, and pencil rod are made of plastic.

28. The method of claim 27, wherein the vapor barrier is a cross-laminated plastic sheet which measures approximately 3–7 mil in thickness.

29. The method of claim 28, wherein the mesh comprises a plurality of crosspieces which form generally rectangular openings measuring approximately 2" by 3" and measures between approximately 1/15" and 1/6" in thickness.

30. The method of claim 29, wherein the pencil rod is a plastic cylinder approximately 3/8" to 1/2" in diameter.

31. The method of claim 30, wherein the vapor barrier, mesh, and pencil rod are made of recycled plastic.

32. A method for repairing pavement, comprising the steps of:

placing at least one pencil rod on an area to be repaired, wherein the pencil rod is a plastic cylinder approximately 3/8" to 1/2" in diameter; and filling the area to be repaired with a patch material.

33. The method of claim 32, wherein the pencil rod is made of a second plastic material which does not soften substantially below 325° F. and the patch material is asphalt.

34. A pavement repair comprising:

a vapor barrier;

a mesh;

at least one pencil rod; and a patch material.

35. The pavement repair of claim 34 wherein the vapor barrier, mesh, and pencil rod are made of plastic.

36. The pavement repair of claim 35, wherein:

the vapor barrier lines an area to be repaired;

the mesh is situated above the vapor barrier;

the pencil rod is situated above the mesh; and the patch material substantially fills the area and substantially encloses the mesh and the pencil rod.

37. The pavement repair of claim 36, wherein the patch material is asphalt.

38. The pavement repair of claim 37, wherein the vapor barrier is made of a plastic material which softens at 275°–325° F. and the mesh and pencil rod are made of a second plastic material which does not soften substantially below 325° F.

39. The pavement repair of claim 35, additionally comprising at least one pencil rod support made of plastic, and wherein:

the vapor barrier lines an area to be repaired;

at least one pencil rod support is situated above the vapor barrier;

the pencil rod is situated above the pencil rod support;

the mesh is situated above the pencil rod; and the patch material substantially fills the area to be repaired and substantially encloses the pencil rod support, the pencil rod, and the mesh.

40. The pavement repair of claim 39, wherein the patch material is concrete.

41. The pavement repair of claim 35, wherein:

the vapor barrier lines an area to be repaired;

the pencil rod is situated above the vapor barrier;

the mesh is situated above the pencil rod; and the patch material substantially fills the area and substantially encloses the mesh and the pencil rod.

42. The pavement repair of claim 41, wherein the patch material is concrete.

* * * * *